United States Patent [19]

Kotcharian

[11] Patent Number: 4,513,550

[45] Date of Patent: Apr. 30, 1985

[54] METHOD OF BUILDING A RESERVOIR FOR STORING A LIQUID AT LOW TEMPERATURE

[75] Inventor: Michel Kotcharian, Paris, France

[73] Assignee: Technigaz, France

[21] Appl. No.: 233,593

[22] Filed: Feb. 8, 1981

[30] Foreign Application Priority Data

Jun. 8, 1979 [FR] France ..... 79 14716

[51] Int. Cl.[3] ..... E04B 1/32; F17C 3/02; F17C 3/04; F17C 13/00

[52] U.S. Cl. ..... 52/249; 220/155; 220/901; 52/410; 52/573; 52/DIG. 4; 52/741; 52/574; 52/609; 52/65

[58] Field of Search ..... 52/249, 410, 573, 265, 52/267, 609, 574, 741, DIG. 4, 65, 514, 747; 220/435, 901; 110/336

[56] References Cited

U.S. PATENT DOCUMENTS

| | | | |
|---|---|---|---|
| 1,970,209 | 8/1934 | Weaton | 52/609 |
| 2,854,842 | 10/1958 | Hosbein | 110/336 |
| 3,562,977 | 2/1971 | Alleaume | 52/249 |
| 3,669,815 | 6/1972 | Desai et al. | 52/249 |
| 4,041,722 | 8/1977 | Terlesky | 52/265 |
| 4,117,947 | 10/1978 | Androulakis | 52/249 |
| 4,180,951 | 1/1980 | Francioni | 52/249 |

FOREIGN PATENT DOCUMENTS

| | | | |
|---|---|---|---|
| 2267512 | 4/1974 | France | 220/901 |

*Primary Examiner*—John E. Murtagh
*Assistant Examiner*—Kathryn Ford
*Attorney, Agent, or Firm*—Steinberg & Raskin

[57] ABSTRACT

The present invention relates to a method of building a reservoir for storing liquefied natural gas at low temperature.

This method consists in fixing on the internal wall 22 of the concrete vessel 3 a first thin lining 21 forming a first fluid-tight barrier, then in completely filling the space between the tank 2 and the concrete vessel 3 by means of a heat-insulating structure comprising an assembly of stacked blocks 25 of insulating material, associated with a second thin lining 24 forming a second fluid-tight barrier, said structure being supported by the concrete vessel and simply arranged round the inner tank.

The building method according to the invention applies in particular to liquefied natural gas storage reservoirs installed on solid ground.

14 Claims, 10 Drawing Figures

33
25
28
34
6
27
26
24
29b
30
33
III
III
25
26
34
27
28
23
3
33
30
21
2
35
22
45
32
46
36
42
24
43
44
43
41
4

3
29d
31
25
34
28
27
29c
6
26
33
21
31
-36-
24
32
33
28
29b
22
25
27
26
23
2
31
29a

METHOD OF BUILDING A RESERVOIR FOR STORING A LIQUID AT LOW TEMPERATURE

TECHNICAL FIELD

The present invention relates generally to reservoirs for storing a liquid at low temperature, such as liquefied natural gas, and is concerned more particularly with a method of building such a reservoir, the said reservoir being of the type comprising an inner tank, e.g. of steel, and an outer casing, e.g. of prestressed concrete, separated from the tank by a space of relatively small width filled with heat-insulating means.

PRIOR ART

Reservoirs of this type are already known. However, safety regulations and the users' requirements make it imperative that the external casing of prestressed concrete and the heat-insulating structure fulfil the following conditions:

to withstand the complete flooding of the liquefied natural gas (LNG) in case of leakage;

to withstand thermal shocks;

to withstand external stresses such as cracks in the prestressed concrete and a deformation of the concrete casing;

to prevent LNG projections against the concrete casing in case of rupture of the inner tank; to this end, the space between the outer casing and the inner tank must be filled with a rigid system.

On the other hand, the heat-insulating structure must allow the manufacturing dimensional tolerances of the concrete casing, i.e. the variations in dimension of the space between the inner tank and the outer concrete casing to be compensated for. In practice, this space may have a width of the order of 800 mm with tolerances of ±20 mm. It is therefore understood that the mounting of the heat-insulating structure in this space gives rise to technical problems, in view of the relatively small width of the space between the inner tank and the outer concrete casing, considering that the mounting of the heat-insulating means must be performed after the mounting of the inner tank in the concrete casing.

STATEMENT OF THE INVENTION

The purpose of the present invention is to obviate these difficulties and to fulfil the aforesaid safety requirements by providing a novel method of building a LNG storage reservoir that is simple and entirely satisfactory.

To this end, the invention is directed to a method of building a reservoir for storing a liquid at low temperature, such as liquefied natural gas, comprising an inner tank, e.g. of steel, and an outer casing or vessel, e.g. of prestressed concrete, separated from the tank by a space of relatively small width filled with heat-insulating means forming a secondary barrier, characterized in that it consists in previously building the outer vessel and thereafter mounting the inner tank therein, and then building the heat-insulating structure in the said space by carrying out the following operations:

arranging on the inner wall of the concrete vessel a continuous coating forming a first fluid-tight barrier;

and then completely filling the said space with a composite heat-insulating structure comprising an assembly of stacked blocks of an insulating material such as expanded polystyrene, associated with a second, continuous thin coating of cryogenic material forming a second fluid-tight barrier, the said structure being supported by the concrete vessel and simply arranged around the inner tank, the building of the said structure by stacking the blocks being performed either in horizontal slices or in vertical bands.

The invention also relates to the reservoirs obtained by carrying out the above method.

BRIEF DESCRIPTION OF THE DRAWINGS

Other characterizing features and advantages of the invention will appear more clearly from the following detailed description with reference to the appended drawings given solely by way of example and wherein.

BEST WAYS OF REDUCING THE INVENTION TO PRACTICE

Figure 1:
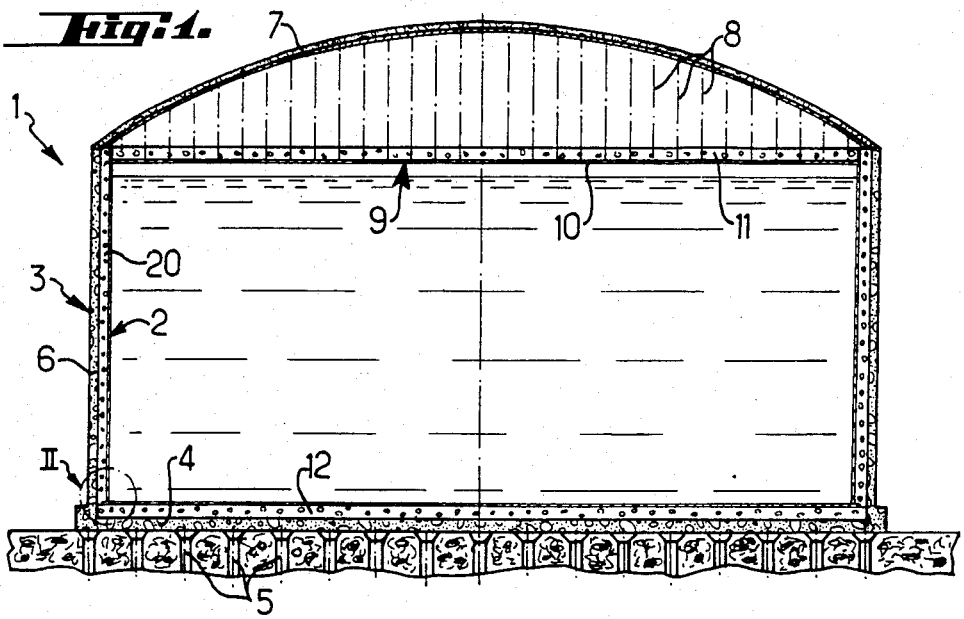
FIG. 1 is a sectional view of the reservoir.

Reference is first made to FIG. 1, in which there is shown a reservoir 1 for storing liquefied natural gas (LNG) at low temperature according to the invention. The reservoir is essentially constituted by an inner steel tank 2 surrounded with a rigid outer casing or vessel 3 comprising a concrete floor 4 resting upon a foundation 5, a prestressed concrete skirt 6 and a concrete vault or cupola 7 from which is suspended, by means of cables 8, a ceiling 9 comprising beams 10 on which rests a layer of heat-insulation 11 constituted by glass-wool blocks.

On the floor 4 are arranged juxtaposed rigid blocks of insulating material forming a heat-insulating structure 12 for the reservoir bottom. This heat-insulating structure will be detailed later, especially in describing FIG. 2.

On the other hand, the space between the vertical walls of the inner tank 2 and those of the outer prestressed-concrete vessel 3 is filled with a heat-insulating structure 20 forming a secondary barrier. In practice, the width of this space may be of the order of 800 mm, with tolerances of ±20 mm.

Figure 2:
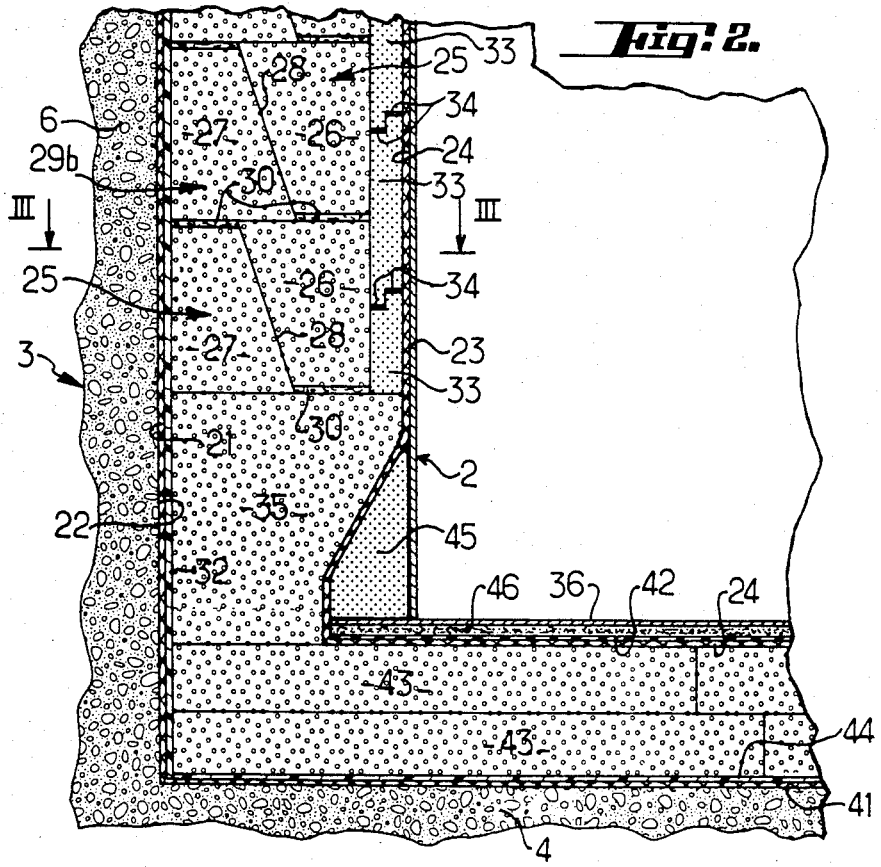
FIG. 2 is a detailed view, to a larger scale, of the encircled portion II of FIG. 1 according to a first form of embodiment.

Referring now to FIG. 2, a first thin continuous coating 21 of cryogenic maerial forming a first fluid-tight barrier is adhesively secured to the vertical inner walls 22 of the prestressed-concrete vessel 3. The coating 21 may be constituted, for example, by a material known as "triplex" which is composed of an aluminium layer interposed between two glass-cloth layers. Along the vertical walls 23 of the steel tank 2 is laid a second, continuous thin coating 24 of cryogenic material forming a second fluid-tight barrier. The coating 24 may be constituted by bands or panels of the material called "triplex". These "triplex" bands forming the second fluid-tight barrier 24 may be either suspended vertically, by their upper end, from an attachment provided at the top of the concrete vessel 3, or placed initially along the vertical walls 23 of the tank by being magnetized for example by means of small magnetic elastomer blocks secured to the bands of "triplex". Thereafter, the bands are jointed in a fluid-tight manner.

The space comprised between the two fluid-tight barriers 21 and 24 is filled with a composite heat-insulating structure comprising an assembly of stacked blocks 25 of insulating material, such as for example expanded polystyrene, the said structure being supported by the concrete vessel 3 and simply arranged around the inner tank 2, the construction of the structure by stacking the blocks 25 being performd either in horizontal slices or in vertical bands. More precisely, each block 25 is in the shape of a rectangled parallelepiped constituted by two complementarily shaped half-blocks 26 and 27 applied against one another according to an inclined plane 28 so as to be slightly slidable on one another to compensate for the dimensional tolerances of the space between the inner tank 2 and the outer concrete vessel 3.

Figure 3:
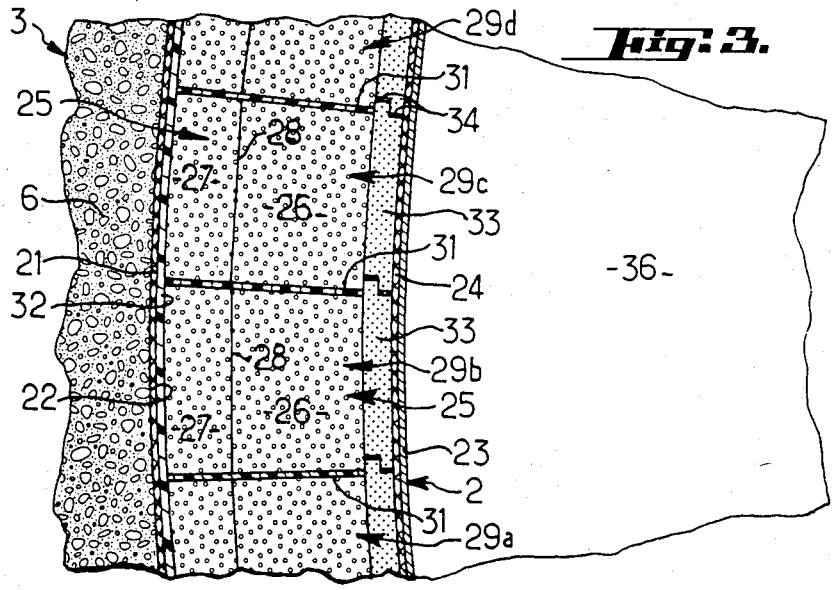
FIG. 3 is a sectional view upon III—III of FIG. 2.

As seen in FIGS. 2 and 3, in order to obtain the heat-insulating structure, there are formed adjacent vertical bands 29*a*, 29*b*, 29*c*, 29*d* . . . of stacked blocks 25, each block 25 of a vertical band (e.g. the band 29*b*) being placed vertically on the lower block starting from the bottom of the space between the inner tank 2 and the outer concrete vessel 3, and the two half-blocks 26 and 27 being arranged complementarily at the same level, one (26) nearer to the tank 2 and the other (27) nearer to the concrete vessel 3 in such a manner as to be slidable on one another in a vertical plane and radially with respect to the tank 2. Flexible or compressible gaskets or like sealing means 30, e.g. of glass wool, are placed between the two superposed half-blocks 26 (and 27) of a same vertical band (e.g. the band 29*b*), flexible gaskets or the like 31 (FIG. 3), e.g. of polyurethane, are provided between two adjacent vertical bands 29*a* and 29*b*, 29*b* and 29*c* . . . , and a flexible gasket or the like 32, e.g. of polyurethane, is provided between the half-blocks 27 and the first fluid-tight barrier 21.

On the other hand, a lining or coating formed of vertical polyurethane panels 33 with stepped joints is provided between the blocks 25 and the second fluid-tight barrier 24. More precisely, the panels 33 are only adhesively secured on the second fluid-tight barrier 24 and interconnected by two flat gaskets 34, e.g. of glass-wool. At 35 is shown an expanded polystyrene block of particular shape placed in the lower portion of the heat-insulating structure.

Referring again to FIG. 2, the heat-insulating structure arranged between the floor 4 of the concrete vessel 3 and the bottom 36 of the tank 2 comprises a first continuous thin lining or coating 41 forming a first fluid-tight barrier adhesively secured to the floor 4 of the concrete vessel 3, and the second continuous thin lining or coating 24 of "triplex" forming the second fluid-tight barrier covered with a protecting film 42 based for example on epoxy. The second lining 24 is therefore arranged in a continuous manner on the vertical walls of the tank 2 and on the panels 43 of insulating material such as foam glass, a flexible gasket 44 being interposed between the panels 43 and the first fluid-tight barrier 41.

There is shown at 45 a special block, e.g. of polyurethane, of a complementary shape to that of the block 35, the second lining or coating 24 forming the second fluid-tight barrier being interposed between the two blocks 35 and 45. Moreover, a layer of sand or other appropriate material 46 is interposed between the bottom 36 of the tank 2 and the protecting film 42 of the second fluid-tight barrier (or upper fluid-tight barrier) 24.

Figure 4:
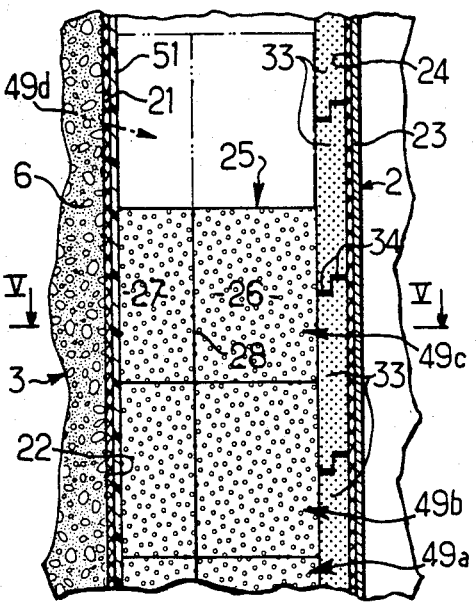
FIG. 4 is a view, similar to FIG. 2 of a vertical wall alone, according to a second form of embodiment.
Figure 5:
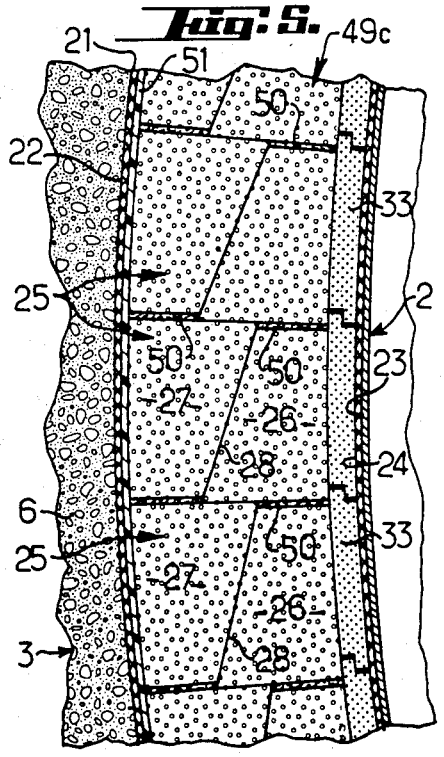
FIG. 5 is a sectional view upon V—V of FIG. 4.

Referring to FIGS. 4 and 5 representing a variant of FIGS. 2 and 3, in which the elements identical with those of FIGS. 2 and 3 are designated by the same reference numerals, in order to obtain the heat-insulating structure, there are formed successive horizontal levels 49*a*, 49*b*, 49*c*, 49*d* . . . of blocks 25 placed side by side in a same level and vertically stacked from one level to the other, the two half-blocks 26 and 27 being arranged in a complementary manner at the same level, one (26) nearer to the tank 2 and the other (27) nearer to the concrete vessel 3 so as to be slidable on one another in a horizontal plane and tangentially with respect to the tank 2. Flexible or compressible gaskets 50, e.g. of glass wool, are placed between the two consecutive half-blocks 26 and 27 of a same horizontal level (e.g. the level 49*c*), and a flexible gasket 51, e.g. of polyurethane, is placed between each horizontal level 49*a*, 49*b*, 49*c*, 49*d* . . . , at the level of the half-blocks 27, and the first fluid-tight barrier 21.

Figure 6:
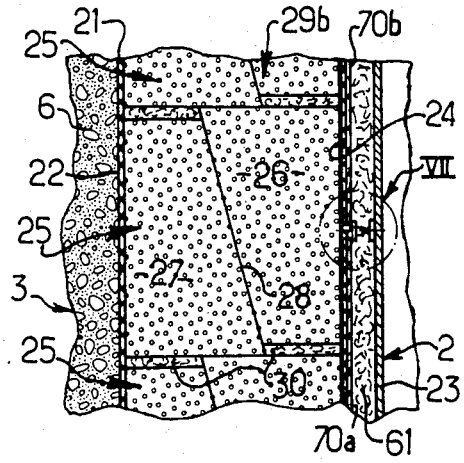
FIG. 6 is a view, similar to FIG. 2, of a vertical wall alone, according to a third form of embodiment.
Figure 8:
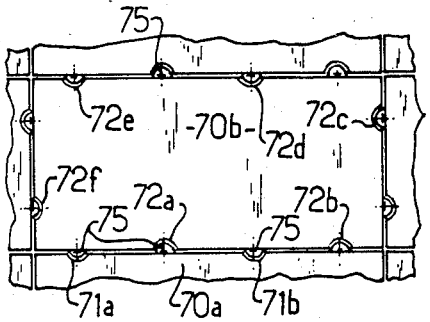
FIG. 8 is a view in the direction of arrow VIII of FIG. 7, with the insulating block and the second fluid-tight barrier removed.
Figure 7:
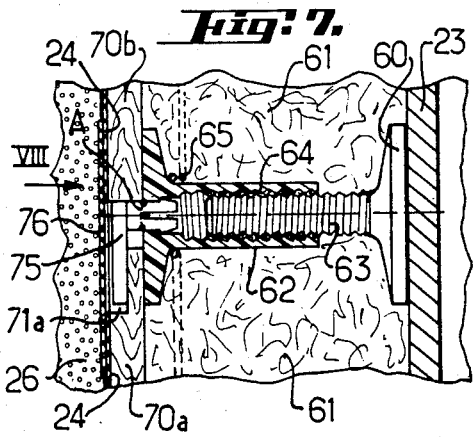
FIG. 7 is a detailed view, to a larger scale, of the encircled portion VII—VII of FIG. 6.

Referring now to FIGS. 6, 7 and 8, in which the elements identical with those of FIGS. 2 and 3 are designated by the same reference numerals, there are adhesively secured, from place to place on the vertical wall 23 of the tank 2, fixing pins 60 extending perpendicularly to this wall, and there are mounted on the pins 60 panels 61 of insulating material such as glass wool by means of tubular sleeves 62 supporting panels 61. More precisely, the pins 60 are provided with a thread 63 and the sleeves 62 are also provided with a thread 64 greater in diameter than the thread 63, so that when inserting pins 60 into the sleeves 62, both threads 63 and 64 are coated for example with an adhesive material, thus ensuring excellent adherence of the sleeves 62 on the pins 60. Moreover, the glass-wool panels 61 are retained by means of a wire trellis 65.

Panels 70*a*, 70*b*, . . . (FIGS. 7 and 8), e.g. of plywood, are provided on their periphery with notches alternating from one panel to the other and cut at the level of the sleeves 62, each panel being provided for example with six notches. Thus, there is shown in FIG. 8 the panel 70*a* with two notches 71*a* and 71*b* in its upper edge, and there is seen the panel 70*b* provided in its lower edge with two notches 72*a* and 72*b* inverted with respect to the notches 71*a* and 71*b* of the panel 70*a*, and its four other notches 72*c*, 72*d*, 72*e* and 72*f*. Thus, in mounting the panels 70*a* and 70*b* and assuming the panel 70*a* to be mounted, the alternate position of the notches 72*a* and 72*b* of the lower edge of the panel 70*b* with respect to the notches 71*a* and 71*b* of the upper edge of the panel 70*a* allows the panel 70*b* to rest on the panel 70*a* with, however, a very small play. Through the notches 72*a*, 72*b*, 72*c* . . . of the panel 70*b*, cotter-pins 75 (FIG. 7) are socketed into the sleeves 62, thus retaining the panel 70*b* in place. All the other panels are positioned in the same manner. It will be noted that the cotter-pins 75 present a preferential breaking line represented by the letter A, which allows the panels 70*a*, 70*b* . . . to remain in place when the vertical walls 23 of the tank 2 retract.

On the outer face of the panels 70*a*, 70*b* . . . , the bands or the panels intended to form the second fluid-tight barrier, e.g. of triplex, are fastened for example adhesively and are jointed together in a fluid-tight manner. This fluid-tight joint is shown at 76.

As seen in FIG. 6, the heat-insulating structure comprises only a stack of blocks 25 interposed between the two fluid-tight barriers 21 and 24. As in the case of FIGS. 2 and 3, there can be formed for example adjacent vertical bands 29*a*, 29*b* . . . of stacked blocks 25, each block of a vertical band (e.g. the band 29*b*) being placed vertically on the lower block starting from the bottom of the space between the inner tank 2 and the outer concrete vessel 3, and the two half-blocks 26 and 27 being arranged complementarily at the same level, one (26) nearer to the tank 2, the other (27) nearer to the concrete vessel 3 so as to be slidable on one another in a vertical plane and radially with respect to the tank 2.

Figure 9:
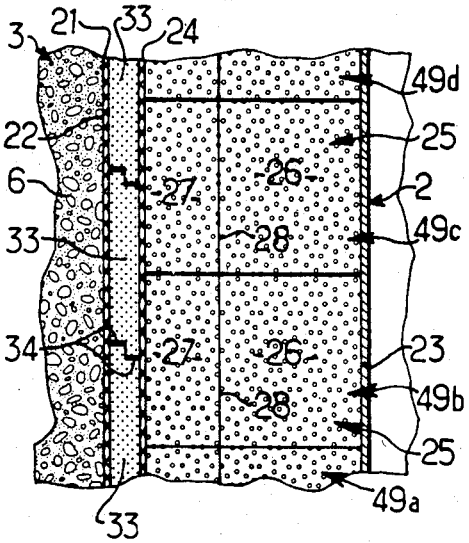
FIG. 9 is a view, similar to FIG. 2, of a vertical wall alone, according to a fourth form of embodiment.

Referring to FIG. 9, in which the elements identical with those of FIG. 2 have the same reference numerals, the lining formed by the polyurethane panels 33 is adhesively secured on the first fluid-tight barrier 21, along the vertical walls 22 of the outer concrete vessel 3. As in the case of FIG. 2, the panels 33 are interconnected by two flat gaskets 34, e.g. of glass wool. The second fluid-tight barrier 24 is thereafter adhesively secured on the polyurethane panels 33, and then the stack of blocks 25 is mounted between the second fluid-tight barrier 24 and the vertical walls 23 of the tank to form the heat-insulating structure. More precisely, the blocks 25 are adhesively secured on the second fluid-tight barrier 24 and are simply in contact with the vertical walls 23 of the tank. As previously, each block 25 is in the form of a rectangled parallelepiped formed of two half-blocks 26 and 27 of complementary shape applied on one another according to an inclined plane 28 so as to be slightly slidable on one another to compensate for the dimensional tolerances of the space between the inner tank 2 and the outer concrete vessel 3.

As in the case of FIG. 4, there may be formed for example successive horizontal levels 49*a*, 49*b*, . . . of blocks 25 placed side by side in one and the same level and vertically stacked from one level to the other, the two half-blocks 26 and 27 being arranged complementarily at the same level, one (26) nearer to the tank 2, the other (27) nearer to the concrete vessel 3 so as to be slidable on one another in a horizontal plane and tangentially with respect to the tank 2.

Figure 10:
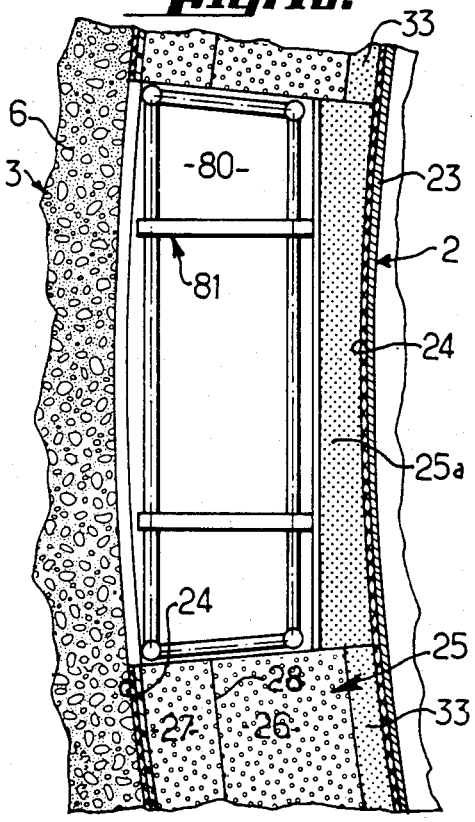
FIG. 10 is a view, similar to FIG. 3, showing an inspection or access hole.

Referring now to FIG. 10, in which the elements identical with those of FIG. 3 are designated by the same reference numerals, a vertical access hole 80 extending throughout the height of the heat-insulating structure is provided between the outer concrete vessel 3 and the inner tank 2. In the hole 80 is arranged a rigid armature or framework 81 forming a cage secured to an expanded polyurethane block 25*a* which is directly in contact with the second fluid-tight barrier 24. The rigid armature 81 allows the efforts applied to the vertical walls 23 of the inner tank 2 to be transmitted to the concrete vessel 3.

The access hole or holes 80 (for example, four of them may be provided along the circumference of the storage reservoir) are very useful for making repairs, e.g. in case of leakage in the inner tank 2. To this end, air is blown under the dry inner tank 2, and by using appropriate means, a tank is caused to rotate on the air cushion thus formed so as to position the leak opposite an access hole 80. The repairer can thus go down the hole using the scaffold 81 and then make the required repair.

It will be added, lastly, that the materials constituting the heat-insulating structure have already been tested and have been approved by several official organizations.

I claim:

1. A method of building a reservoir for storing a liquid at low temperature such as liquified natural gas, comprising an inner tank having a top and bottom and an outer casing or vessel having inner and outer walls separated from the tank by a space of relatively small width filled with heat-insulating means forming a secondary barrier, characterized in that it comprises previously building the outer vessel and in mounting therein the inner tank, and then in building the heat-insulating means in the aforesaid space by performing successive operations comprising the steps of:

arranging on the inner wall of the outer vessel a continuous lining forming a first fluid-tight barrier;

arranging bands or panels along the vertical walls of the inner tank without permanently securing said bands or panels, said bands or panels being made of material for forming a second fluidtight barrier, and jointing said bands or panels in a fluid tight manner formed of sub-blocks of complementary shapes contacting against one another so as to be slightly slidable on one another to compensate for the dimensional tolerances of said space between the inner tank and the outer vessel, associated with a second continuous, thin lining of cryogenic material forming a second fluid-tight barrier, the said structure being supported by the outer vessel and arranged simply around the inner tank, the building of the structure by stacking the blocks being performed either in horizontal slices or in vertical bands.

2. A building method according to claim 1, characterized in that it comprises supporting the bottom of the tank within the outer vessel by means of a heat-insulating structure comprising the two aforesaid fluid-tight barriers between which are placed panels of insulating material such as foam glass, a layer of sand or of another appropriate material being interposed between the bottom of the tank and the upper fluid-tight barrier.

3. A method of building a reservoir for storing a liquid at low temperatures such as liquified natural gas, comprising an inner tank having vertical walls and an outer casing or vessel having inner and outer walls separated from the tank by a space of relatively small width filled with heat-insulating means forming a secondary barrier, characterized in that it comprises at first building the outer vessel, in mounting therein the inner tank, and then in building the heat-insulating means in said space by performing successive operations comprising the steps of:

arranging on the inner wall of the outer vessel a continuous lining forming a first fluid-tight barrier;

along the vertical walls of the tank placing without securing them finally, bands or panels of material intended to form a second fluid-tight barrier, and in jointing them in a fluid-tight manner;

and then in mounting between the two fluid-tight barriers a stack of blocks of insulating material so as to completely fill said space to form the said heat-insulating means, each block being in the shape of a rectangled parallelepiped formed of two half-blocks of complementary shapes applied against one another according to an inclined plane so as to be slightly slidable on one another to compensate for the dimensional tolerances of the aforesaid space between the inner tank and the outer vessel.

4. A building method according to claim 3, characterized in that it comprises the steps of providing, between the aforesaid blocks and the aforesaid second fluid-tight barrier, a lining secured on the second fluid-tight barrier.

5. A building method according to claim 3, characterized in that the bands of material forming the second fluid-tight barrier are suspended vertically by their upper end from an attachment provided at the top of the vessel.

6. A method according to claim 3, characterized in that it comprises the steps of fixing, from place to place on the outer wall of the tank, fixing pins extending perpendicularly to the said wall, in mounting on the said pins panels of insulating material by means of tubular sleeves supporting the panels and slipped onto the pins, in fixing in the said sleeves panels by means of cotter-pins socketed into the sleeves retaining the panels in place, the said cotter-pins presenting a preferential breaking line, and then in fixing on the outer face of the said panels the bands or the panels of cryogenic material intended to form the second fluid-tight barrier and in jointing said bands or panels in a fluid-tight manner.

7. A building method according to claim 3 wherein in order to obtain the aforesaid heat-insulating structure, the method comprises the steps of forming successively adjacent vertical bands of said stacked blocks, each block of a vertical band being placed vertically on the lower block starting from the bottom of the aforesaid space, the two half-blocks forming each block being arranged in complementary manner at the same level, one nearer to the tank, the other nearer to the concrete vessel so as to be slidable on one another in a vertical plane and radially with respect to the tank.

8. A building method according to claim 7, characterized in that flexible or compressible joints are placed between the superposed half-blocks of a same vertical band, and flexible gaskets are provided between two adjacent vertical bands, a flexible joint being provided, if appropriate, between the bands of blocks and the first fluid-tight barrier.

9. A building method according to claim 3 wherein in order to obtain the aforesaid heat-insulating structure, the method comprises the steps of forming, starting from the bottom, successive horizontal levels of blocks placed side by side in a same level and vertically stacked from one level to the other, the two half-blocks forming each block being arranged in a complementary manner at the same level, one nearer to the tank and the other nearer to the reservoir so as to be slightly slidable on one another in an horizontal plane and tangentially with respect to the tank.

10. A building method according to claim 9, characterized in that flexible or compressible gaskets are placed between the consecutive half-blocks of a same horizontal level, and between the first fluid-tight barrier and each aforesaid horizontal level.

11. A building method according to claim 3, comprising the steps of providing, in the aforesaid heat-insulating structure, a vertical access hole extending throughout the height of this structure, and in arranging in this hole a rigid armature forming a cage, for transmitting the efforts to the vessel, the tank being capable, for a repair, of being supported temporarily by an air cushion allowing for its rotation around its vertical axis so as to bring the place to be repaired opposite an access hole.

12. A method of building a reservoir for storing a liquid at low temperature such as liquified natural gas, comprising an inner tank and an outer casing or vessel separated from the tank by a space of relatively small width filled with heat-insulating means forming a secondary barrier, characterized in that it comprises at first building the outer vessel and in mounting therein the inner tank, and then in building the heat-insulating means in said space by performing successive operations comprising the steps of:

arranging on the inner wall of the vessel a continuous lining forming a first fluid-tight barrier;

tightly placing in said space along the vertical walls of the inner tank bands or panels of material intended to form a fluid-tight barrier;

and then in completely filling the said space by means of a composite heat-insulating structure comprising an assembly of stacked blocks of insulating material each block being in the shape of a rectangled parallelepiped formed of two half-blocks of complementary shapes applied against one another according to an inclined plane so as to be slightly slidable on one another to compensate for the dimensional tolerances of said space between the inner tank and the outer vessel, the said structure being supported by the concrete vessel and arranged simply around the inner tank, the building of the structure by stacking the blocks being performed either in horizontal slices or in vertical bands; the bands of material forming the second fluid-tight barrier are placed initially along the vertical walls of the tank through magnetization, by means of small magnetic elastomer blocks secured to said bands.

13. A method of building a reservoir for storing a liquid at low temperature such as liquified natural gas, comprising an inner tank and an outer casing or vessel having inner and outer vertical walls separated from the tank by a space of relatively small width filled with heat-insulating means forming a secondary barrier, characterized in that it comprises at first building the outer vessel, in mounting therein the inner tank, and then in building the heat-insulating means in said space by performing successive operations comprising the steps of:

arranging on the inner wall of the outer vessel a continuous lining forming a first fluid-tight barrier;

securing a lining formed by panels on said first fluid-tight barrier along the vertical walls of the vessel;

securing bands or panels of material intended to form a second fluid-tight barrier on these panels;

and then mounting between the said second fluid-tight barrier and the outer wall of the inner tank, a stack of blocks of insulating material so as to completely fill said space to form the heat-insulating means, each block having the shape of a rectangled parallelepiped formed of two half-blocks of complementary shapes applied on one another according to an inclined plane so as to be slightly slidable on one another to compensate for the dimensional tolerances of the aforesaid space between the inner tank and the outer vessel.

14. In a reservoir for storing a liquid at low temperatures including an inner tank and an outer casing or vessel separated from the tank by a space of relatively small width filled with heat insulating means, the improvement comprising:

first fluid-tight barrier means arranged on an inner wall of the outer vessel;

second fluid-tight barrier means placed along an outer wall of the tank; and wherein said heat-insulating means are situated between said first and second fluid-tight barrier means and include a stack of blocks of insulating material, each block being in the shape of a rectangular parallelepiped formed of at least two sub-blocks of complementary shapes contacting each other along respective surfaces lying in an inclined plane so as to be slightly slidable on one another at least in the direction of the width of the space between the inner tank and outer vessel to compensate for the dimensional tolerances of the space.

* * * * *